US005841056A

United States Patent [19]

Long et al.

[11] Patent Number: 5,841,056

[45] Date of Patent: Nov. 24, 1998

[54] WATER DEFLECTOR FOR WATER-GAS PLUMES FROM UNDERWATER EXPLOSIONS

[75] Inventors: John B. Long, Sarasota, Fla.; Pius Chao; Donald Waits, both of El Cerrito, Calif.

[73] Assignee: Hydrodyne Incorporated, Sarasota, Fla.

[21] Appl. No.: 845,169

[22] Filed: Apr. 21, 1997

Related U.S. Application Data

[60] Provisional application No. 60/018,778 May 31, 1996.

[51] Int. Cl.[6] ..... F42B 33/00; E06B 9/00

[52] U.S. Cl. ..... 86/50; 109/49.5

[58] Field of Search ..... 86/50; 102/303; 109/49.5

[56] References Cited

U.S. PATENT DOCUMENTS

| | | | |
|---|---|---|---|
| 3,492,688 | 2/1970 | Godfrey . | |
| 3,611,766 | 10/1971 | Klein et al. . | |
| 3,721,201 | 3/1973 | Boller | 86/50 |
| 4,079,612 | 3/1978 | Smirnov et al. . | |
| 4,326,468 | 4/1982 | King et al. | 109/49.5 |
| 4,727,789 | 3/1988 | Katsanis et al. | 86/50 |
| 5,225,622 | 7/1993 | Gettle et al. . | |
| 5,273,766 | 12/1993 | Long . | |
| 5,328,403 | 7/1994 | Long | 452/141 |
| 5,390,580 | 2/1995 | Gibbons, Jr. et al. | 86/50 |
| 5,394,786 | 3/1995 | Gettle et al. | 86/50 |

FOREIGN PATENT DOCUMENTS

| | | |
|---|---|---|
| 2628547 | 1/1977 | Germany . |
| 2110179 | 6/1983 | United Kingdom . |

OTHER PUBLICATIONS

English Language Abstract, SU 918 775, Apr. 7, 1982.

*Primary Examiner*—Charles Jordan
*Assistant Examiner*—Theresa M. Wesson
*Attorney, Agent, or Firm*—Browdy and Neimark

[57] ABSTRACT

An explosive blast shield has two connected parts, a foraminous inner shield surrounded by an impervious outer shield. The inner shield has an open lower end to absorb an explosive blast of water and gas, as from an underwater explosion. The inner shield, whose area is about 20% holes, blocks most liquid from entering the space between the two shields, but gas passes readily through the holes to equalize the pressure across the inner shield. The shield may include a chimney at the upper end for release of gas and a hold-down to prevent the shield from being blown upward.

20 Claims, 3 Drawing Sheets

WATER DEFLECTOR FOR WATER-GAS PLUMES FROM UNDERWATER EXPLOSIONS

CROSS-REFERENCE TO RELATED APPLICATION

This application claims the benefit of U.S. Provisional Application No. 60/018,778 filed on May 31, 1996.

FIELD OF THE INVENTION

The present invention relates to apparatus for absorbing explosive energy, and more particularly for absorbing the energy in a mixture of an explosive plume of liquid and expanding gas, such as that from an underwater explosion.

REVIEW OF THE RELATED TECHNOLOGY

U.S. Pat. No. 5,328,403, issued to one of the present inventors, John B. Long, discloses a meat tenderizer using a shock wave from an explosive charge to tenderize meat at the bottom of a steel explosion container, denoted as holding tank 50, which is open at the top. The hemispherical bottom of the holding tank is lined with the meat to be tenderized and is filled with water. An explosive is mounted at the geometrical center of the hemisphere and detonated. The shock waves pass through the meat, tenderizing it.

To contain the explosive force and up-rushing mixed water and gas, an hydraulically-damped shield 52 is disclosed. It has now been found that a large part of the force due to the explosion is associated not with the gas bubble formed of explosive by-products and steam, but instead with the moving water blown upwardly by the expanding gas. Hot gas is much less dense than water and its momentum is therefore much less. The shield 52 does not take this difference in momentum into account, and therefore it takes the full force of the water directly. As a result, such shield must be stronger than is desirable and necessary. Furthermore, because the shield 52 is frusto-conical, the upwardly exploding water tends to become concentrated at the flat nose of the cone. Water thrown up over a large solid angle is channeled into a narrow channel and suddenly stopped. This makes the maximum instantaneous force greater.

In addition, the simple frusto-conical shield 52 does little to prevent the water from splashing about. As the shield is pushed upward by the blast, the water—still rushing terrifically about inside—tends to spray out of the gap between the lower holding tank and the rising shield 52.

SUMMARY OF THE INVENTION

Accordingly, the present invention has an object, among others, to overcome deficiencies in absorbing energy from underwater explosions in the prior art, such as in the environment noted above.

The invention thus provides a multi-part blast shield which separates water from gas in plumes from underwater explosions. An outer shield, essentially imperforate and impervious to fluids, encloses an inner shield which is foraminous and permeable. The inner shield preferably has approximately 20% of its surface area in through-openings such as round holes. Fluid can pass readily through these holes. An intermediate space or gap is located between the inner shield and the outer shield, forming a buffer chamber. Both shields are open at the bottom, and the buffer chamber is preferably also open at the bottom. The rims of the inner and outer shields are preferably aligned in the vertical direction, e.g. are coaxial, so that the thickness of the space or gap is radially consistent.

The cavity inside the inner shield faces a holding tank full of water and an explosive. When the explosion occurs, the outward-rushing gas pushes water ahead of it and, to the extent it is turbulent, entrains water. A great deal of water is thrown against the inner shield at very high speed. As water is dense and has high momentum, it is difficult to deflect as compared to gas. Water hitting a hole in the foraminous inner shield will pass through and strike the inside of the impervious outer shield. Since the holes are roughly 20% of the inner shield area, this represents about 20% of the force on the outer shield which would be exerted if the inner shield were absent.

Gas which impacts on solid areas of the inner shield is more readily deflected and, driven by locally lower pressure at the holes, will turn and rush through into the buffer chamber between the inner and outer shields. Some of the water will be turned by the lateral velocity of the gas and carried through the holes, but large portions of the water will have too much momentum and will strike the inner shield. Thus the inner shield will have great momentum imparted to it.

Because the inner shield is somewhat resilient, and also because there is also some resilience in the mounting of the inner shield to and/or within the outer shield, there will be a time delay in the momentum transferred to the outer shield from the water hitting the inner shield. (The inner shield must deflect internally and/or move upwardly before it can exert any force on the outer shield; as it has appreciable mass it will accelerate relatively slowly and will take some time to move upward.) In other words, the impact of the explosion will be spread over a greater time, resulting in lower force on the outer shield and the shield mounting hardware.

Shortly after the plume of gas and water hits the inner shield, a larger proportion of the easily-deflected gas will have entered the buffer chamber and a greater proportion of the dense water will remain inside the inner shield. Because the gas can quickly enter the buffer chamber, the pressure in the buffer chamber will soon approximate the pressure inside the inner shield. At this point the outward flow of both gas and water through the inner shield holes will cease. As the energy of the explosion is dissipated, therefore, the majority of the water plume remains inside the inner shield. The diameter of the inner shield is preferably chosen to approximate that of the holding tank below, and so the bulk of the water simply falls down back into the holding tank.

As compared to prior-art explosion absorbers, the commotion of gas and liquid inside the shields is more damped by the friction of the gas passing through the holes. This means that while the total upward momentum to be absorbed is about the same as without the foraminous inner shield, the energy absorbed by the mounting is less, and therefore the mounting does not need to be so strongly constructed.

In sum, the present invention decreases splashing out of the holding tank and reduces the force and energy that must be absorbed by the impervious shield and its mounting.

One embodiment of the present invention includes a third element, a deflector disposed inside the inner shield, for example, centrally at its upper end. In the preferred embodiment the inner shield has a cylindrical portion open at the bottom rim (generally contiguous with the upper rim of the holding tank) and bounded above by a rounded dome. Since the blast thrust is generally upward, the top of the inner shield dome takes the brunt of the upwardly-exploding plume of water and gas. The deflector has a shape, such as an inverted cone (tip pointing downward), which turns aside the upward-rushing water and gas.

The inverted cone deflector of the present invention has an opposite effect to that of the tip-upward frusto-cone of shield 52 disclosed in the '403 patent discussed above. The shield 52 laterally concentrates the plume and then suddenly stops it at the tip of the cone. To the extent that the water and compressed gases rebound out of the cone downwardly, the momentum transfer to the shield 52 is increased. In contrast, the inverted cone deflector of the present invention disperses the plume, deflecting it outward to hit the inside of the inner shield. This reduces the upward force of the plume, because the radially outward momentum components of the deflected plume do nothing to raise the blast shields. The outward jets can splash both up and down at the inner shield wall to cancel the horizontal momentum of these radial plumes.

In contrast, plumes trapped inside the tip-end-up cone 52 cannot splash downward because of the plume concentration. Thus the stress on the hold-downs is reduced in the present invention. The outward deflection of the present invention also spreads out the kinetic energy of the plume over a large internal area of the inner shield rather than concentrating the energy in a small volume at the tip of the cone 52. This reduces the internal stress and permits a lighter construction.

The deflector, like the inner shield, can optionally be foraminous. A chimney vent can be mounted above the deflector, especially if the deflector is foraminous. The chimney, a pipe connecting the inside of the inner shield to the outside of the apparatus, deflects water but allows gas to escape from the inner shield.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figure 1:
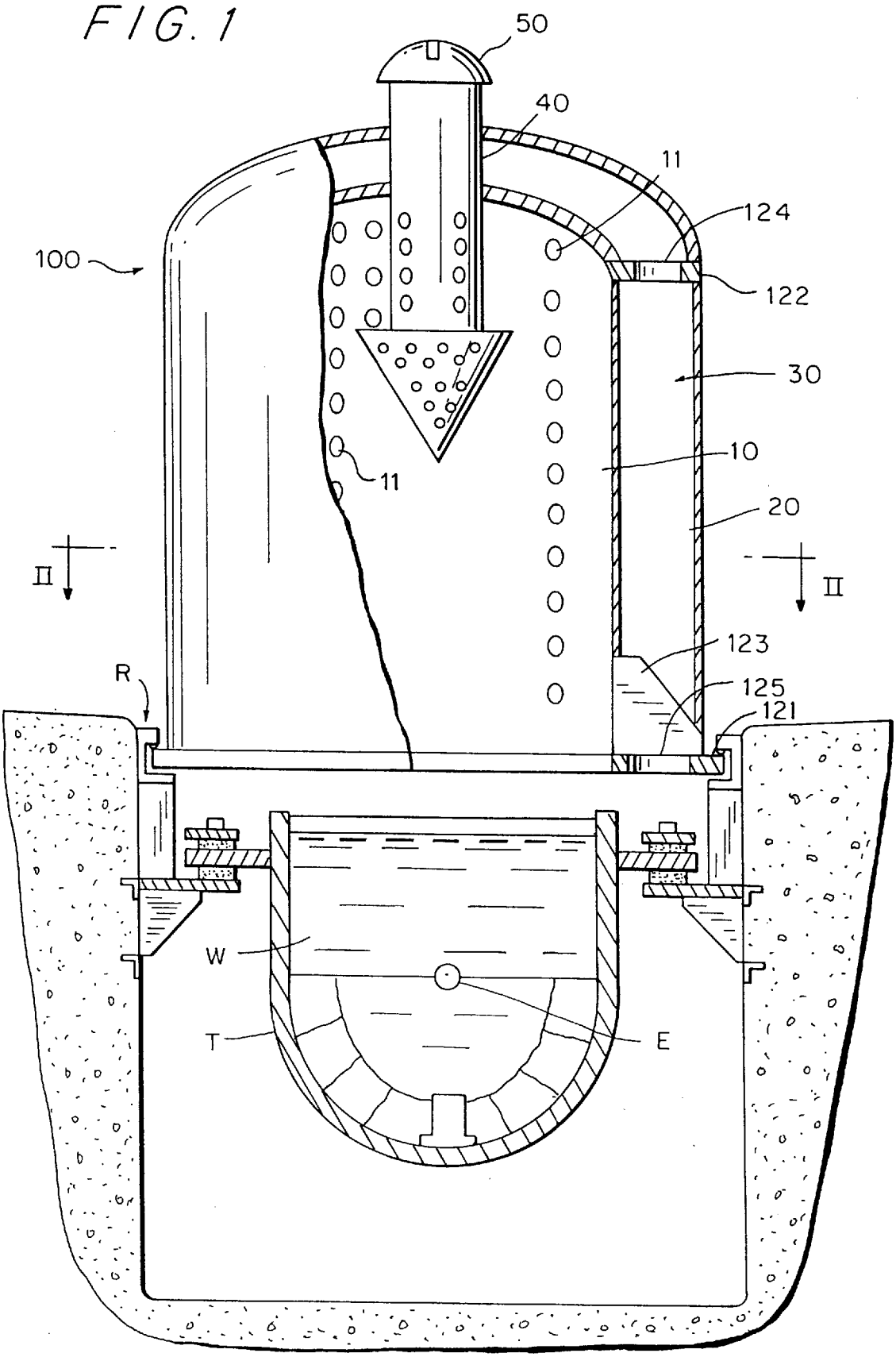
FIG. 1 is an elevational, partially cut-away, view of a blast shield according to the present invention.

FIG. 1 shows the invention, a multipart water-deflecting blast shield 100, in overview, set in the possible environment of use of U.S. Pat. No. 5,328,403, although it is to be understood that other environments of use are also possible. A foraminous inner shield 10 includes a multitude of openings or through-holes 11, such that the surface area of the inner shield 10 is approximately 20% open. Surrounding the inner shield 10 is an outer shield 20 which is solid or impervious, without any openings, to contain fluids inside. The inner and outer shield are both formed preferably of heavy-gauge stainless steel or a similar strong, heavy material capable of withstanding explosive blasts. Both are preferably shaped as domed cylinders. The inner shield 10 has an open lower end which faces toward an explosive blast.

The inner shield 10 and the outer shield 20 are connected near their lower rims by a lower flange 121, stiffened by brackets 123, and at their upper ends by an upper flange 122. The assembly is preferably welded together, although any other connecting means of suitable strength can be used. Thus the two shields 10 and 20 are connected to form a single integral blast shield 100.

Between the inner shield 10 and the outer shield 20 is a space or chamber 30 which is annular along the cylindrical portion of the shield 100. The lower flange 121 includes through-holes 125 which allow water to drain out of the chamber 30. The chamber 30 is open on the inside from within the inner shield 10 through the plural holes 11, but closed on the outside by the solid outer shield 20.

The blast shield 100 of the present invention is intended for use in containing explosive blasts which include a plume of liquid, such as results from an underwater explosion. In FIG. 1 an exemplary structure is shown, of the same type disclosed in U.S. Pat. No. 5,328,403. A holding tank T is filled with water W and an explosive E. When the explosive E detonates, gases and the water plume are directed upward to be contained by the shield of the invention.

Figure 2:
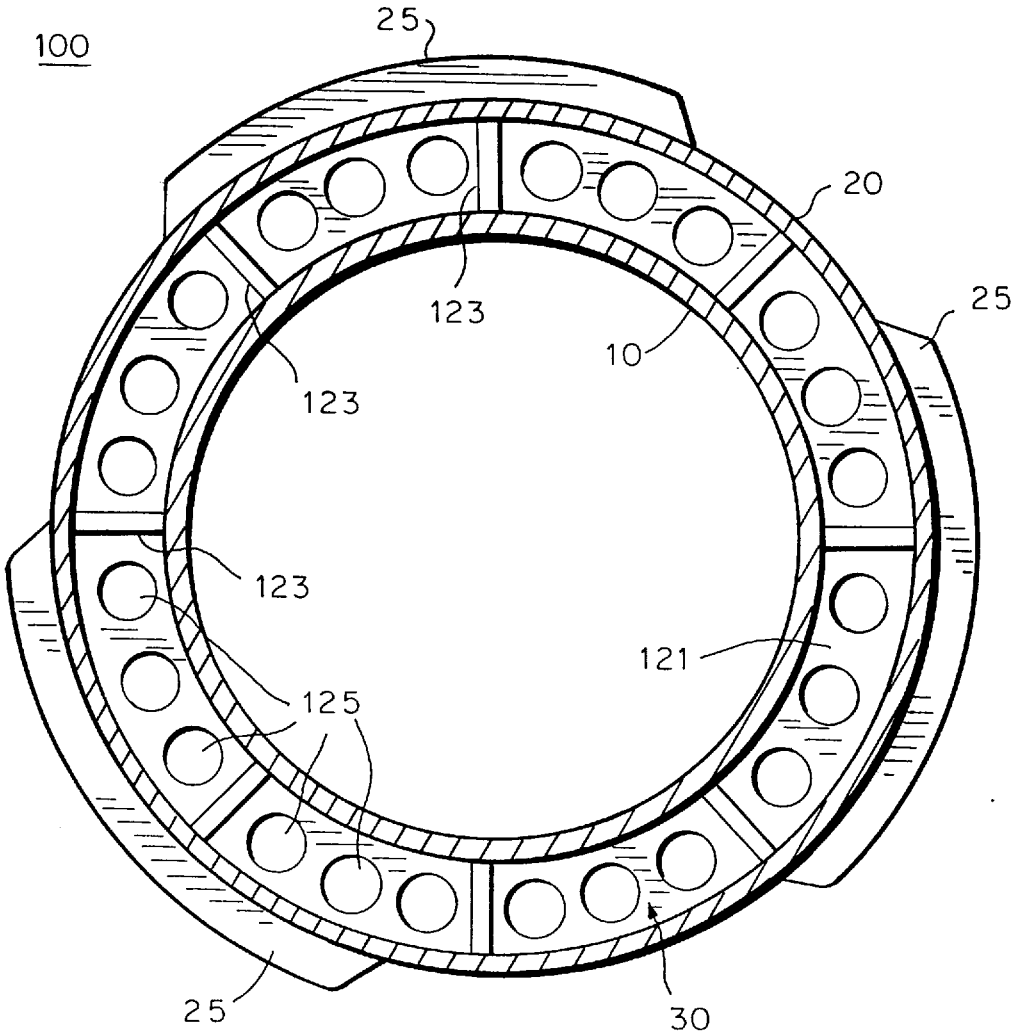
FIG. 2 is a cross sectional view along lines II—II of FIG. 1.

As discussed above, the holes 11 in the inner shield 10 aid in reducing the impact on the outer shield 20, absorb explosion energy, and contain the water mostly inside the inner shield 10 so that the water drains directly downward into the holding tank T. Water which splashes through the holes 11 into the chamber 30 will drain through holes 125 in the lower flange 121 and through holes 124 in the upper flange 122. The lower holes 125 are also shown in cross sectional FIG. 2, taken on section II—II of FIG. 1. This view also shows the reinforcing brackets 123 in plan view.

The blast shield 100 is attachable to a suitable support R by a bayonet-type receiver having angularly interrupted flange teeth 25, which may be extensions of the lower flange 121. The receiver or support R (FIG. 1) has mating inwardly-directed extensions, between which the blast shield teeth 25 fit; after lowering, the blast shield 100 is rotated about its axis so that the teeth 25 slide under respective ones of the receiver extensions, locking the blast shield 100 into position. Alternative hold-downs or attaching means can be provided, including clamps, bolts,a locking ring, and similar releasable mechanical fasteners; welds or adhesives; massive weights; resilient elements like springs; energy-absorbing elements like dashpots or the like; and so on. The hold-down can couple to either the inner or outer shield, or both.

Figure 3:
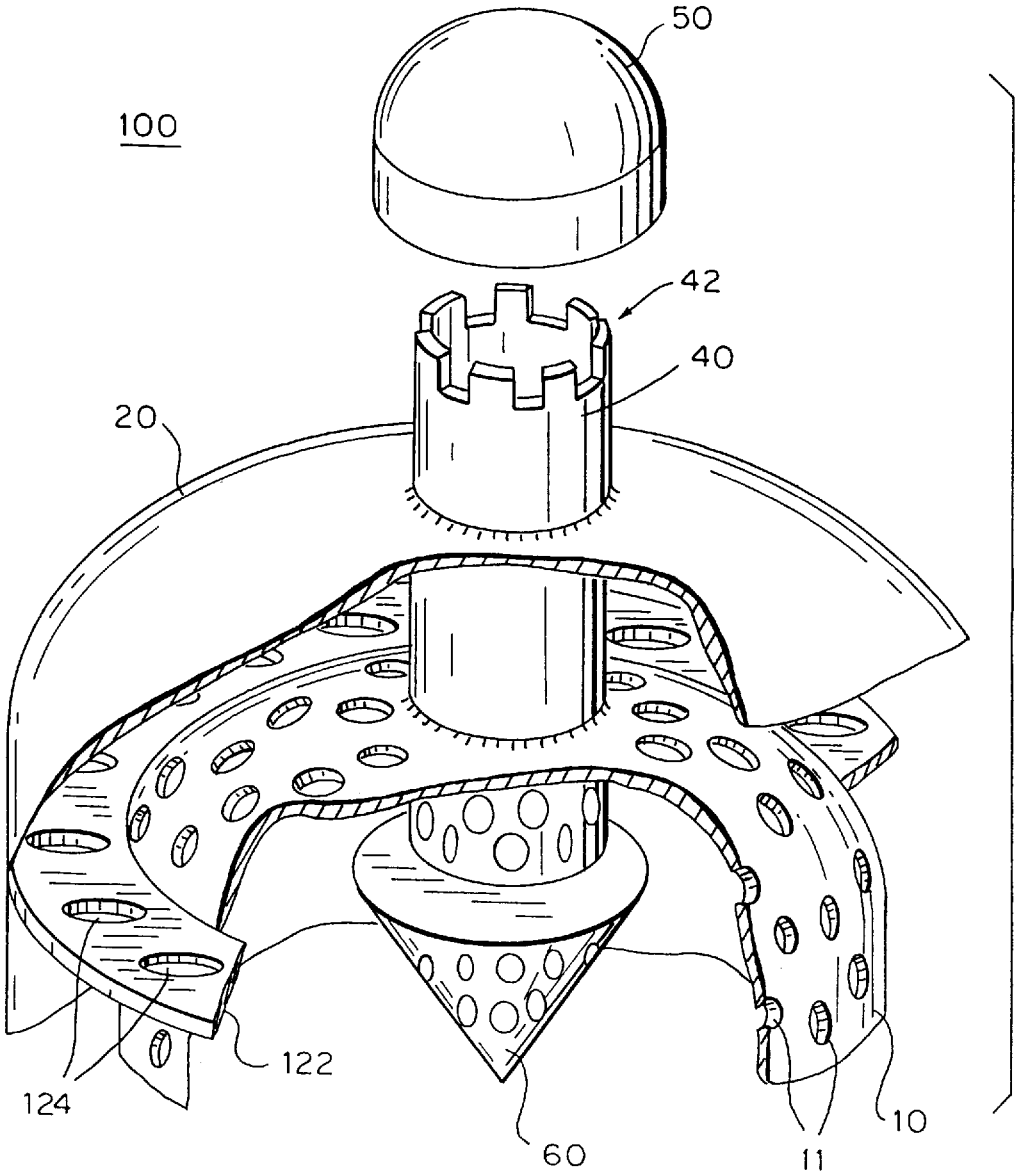
FIG. 3 is a perspective, partially cut-away and exploded view of the upper portion of the invention.

FIG. 3 shows the upper end of the blast shield 100, which includes a hollow tubular chimney 40 covered by a cap 50 which is preferably permanently attached to the chimney 40 but for illustration is shown in FIG. 3 exploded away so that the crenelated upper end 42 of the chimney 40 is visible. The crenelations allows gas to escape from inside the inner shield 10. Equivalent structures such as holes can also or alternatively be used, and/or openings can be provided in the cap 50. FIG. 3 also shows the upper flange 122 with its upper drain holes 124, welded or otherwise strongly connected to the inner shield 10 and outer shield 20. The chimney 40 extends downwardly from the cap 50 through the outer shield 20 and through the inner shield 10. The chimney 40 is preferably impervious within the chamber 30 but foraminous within the space within the inner shield 10.

To deflect the upwardly explosing plume of gas and water, the bottom end of the chimney 40 is preferably capped with a foraminous deflector 60. The deflector 60 may be impervious instead of foraminous as illustrated. The preferred embodiment is conical, but other less preferred shapes may also be used, especially those which include slanting sides, such as for example downwardly pointed cusps, wedges, and the like. The preferred shape is pointed, where "pointed"

(here and in the following claims) refers to a downwardly facing point, cusp or edge, i.e. it covers spikes and also wedges which have a single-point cusp only in cross section. These shapes will deflect the plume to the sides, spreading the impact and reducing the momentum transfer to the blast shield as discussed above.

The blast shield 100 of the present invention is intended for use in containing explosive blasts which include a plume of liquid, such as results from an underwater explosion. In FIG. 1 an exemplary structure is shown, of the same type disclosed in U.S. Pat. No. 5,328,403. A holding tank T is filled with water W and an explosive E. When the explosive E detonates, gases and the water plume are directed upward to be contained by the shield of the invention.

As discussed above, the holes 11 in the inner shield 10 aid in reducing the impact on the outer shield 20, absorb explosion energy, and contain the water mostly inside the inner shield 10 so that the water drains directly downward into the holding tank T. Water which splashes through the holes 11 into the chamber 30 will drain through holes 125 in the lower flange 121 and through holes 124 in the upper flange 122. The lower holes 125 are also shown in cross sectional FIG. 2, taken on section II—II of FIG. 1. This view also shows the reinforcing brackets 123 in plan view.

The terms "upper", "lower", and the like in the preceding description and following claims are descriptive of the preferred embodiment in which the explosion occurs in a lower container, but otherwise are for convenient reference only and do not limit the invention to any orientation. The invention will function regardless of gravity or orientation, since the forces, pressures, and so on resulting from an explosion are much greater than those of gravity. For example, if the apparatus were mounted in centrifuge the gravitational terminology would no longer be strictly accurate, but still descriptive; and if a gel were substituted for water the apparatus could be turned in any direction, even upside down.

The inner shield may include openings of any shape, in any distribution of sizes, and may comprise a mesh, chain link, or similar structure, either reinforced or hung from the outer shell; a cage of joined discrete members such as bars or tubes; a honeycomb-like structure of locally-aligned tubules generally radial to the blast direction; and combinations of these and functionally equivalents structures, as well as the illustrated preferred embodiment of a rigid shell with perforations.

The outer shell may be of any shape and may include conventional shock-absorbing materials or additional deflecting or anti-splash structures on its inner surface.

The industrial applicability is explosive containment. The problem solved by the invention is containment of water plumes from explosions.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

The means and materials for carrying out various disclosed functions may take a variety of alternative forms without departing from the invention. Thus the expressions "means to . . . " and "means for . . . " as may be found in the specification above and/or in the claims below, followed by a functional statement, are intended to define and cover whatever structural, physical, chemical or electrical element or structure may now or in the future exist for carrying out recited function, whether or not precisely equivalent to the embodiment or embodiments disclosed in the specification above; and it is intended that such expressions be given their broadest interpretation.

What is claimed is:

1. An explosive blast shield for containing an upwardly moving plume of gas and liquid coming from below said blast shield, comprising:

a generally cylindrical foraminous inner shell having an open lower end and a closed upper end;

a non-foraminous outer shell surrounding and joined to the inner shell, said outer shell having an open lower end, and a vent passing therethrough; and a space between the inner shell and the outer shell;

whereby gas of an explosive plume moving upwardly into said blast shield more readily escapes through the inner shell than liquid of the explosive plume.

2. The blast shield according to claim 1, comprising hold-down means for keeping the blast shield in a fixed position.

3. The blast shield according to claim 2, wherein the hold-down means includes an annular rim extending outwardly from said inner shell.

4. The blast shield according to claim 1, wherein said vent comprises a chimney means for venting gas from said shield.

5. The blast shield according to claim 4, wherein the chimney includes a downwardly pointed deflector inside the inner shell.

6. The blast shield according to claim 5, wherein the deflector is foraminous.

7. The blast shield according to claim 5, wherein the deflector has a generally conical shape.

8. The blast shield according to claim 1, wherein the inner shell and the outer shell each has a domed cylindrical shape.

9. The blast shield according to claim 8, wherein the space includes a substantially constant thickness gap between the inner shell and the outer shell.

10. The blast shield according to claim 8, wherein the inner and outer shells are joined by connector means including at least one flange joining the inner shell and the outer shell.

11. The blast shield according to claim 1, wherein the foraminous inner shell comprises a surface area including approximately 20% through-openings.

12. An explosive blast shield for containing a plume of gas and liquid, comprising:

a foraminous inner shield having an open lower end;

a non-foraminous outer shield surrounding and joined to the inner shield;

a space between the inner shield and the outer shield;

a chimney for venting gas from said shield, wherein the chimney is at least partially foraminous;

whereby gas of an explosive plume more readily escapes through the inner shield than liquid of the explosive plume.

13. An explosive blast shield for containing a plume of gas and liquid, comprising:

a foraminous inner shield having an open lower end;

a non-foraminous outer shield surrounding and joined, to the inner shield;

a space between the inner shield and the outer shield;

a chimney for venting gas from said shield, wherein the chimney includes an upper end covered with a cap, the upper end and the cap having a gap therebetween for gas to escape from the blast shield through the chimney;

whereby gas of an explosive plume more readily escapes through the inner shield than liquid of the explosive plume.

14. An explosive blast shield for containing a plume of gas and liquid, comprising:

a foraminous inner shield having an open lower end;

a non-foraminous outer shield surrounding the inner shield;

a space between the inner shield and the outer shield; and connector means for joining the inner shield and the outer shield into a unit, said connector means including at least one flange Joining the inner shield and the outer shield, and drain holes in the flange;

whereby gas of an explosive plume more readily escapes through the inner shield than liquid of the explosive plume.

15. An explosive blast shield for containing a plume of liquid and gas arising from an explosion occurring within the liquid, comprising:

a shield having an open lower end and concentric inner and outer shells closed at upper ends thereof, the inner shell having openings therethrouqh and the outer shell being substantially impervious;

a chimney for venting gas out of the blast shield; and a deflector within the inner shell, mounted over an inner end of the chimney, and including a point oriented downwardly toward the plume for radially dispersing the plume;

whereby gas of an explosive plume escapes more readily through the inner shell than liquid of the explosive plume.

16. The blast shield according to claim 15, wherein the deflector is foraminous.

17. The blast shield according to claim 15, wherein the chimney includes an upper end covered with a cap, the upper end and the cap having a gap therebetween for gas to escape from the blast shield.

18. The blast shield according to claim 15, wherein said deflector has a generally conical shape.

19. The blast shield according to claim 15, wherein said inner and outer shells both have a generally circular-cylindrical, vertically extended sidewall and a domed upper wall.

20. An explosive blast shield for containing a plume of liquid and gas arising from an explosion occurring within the liquid, comprising:

a shield having an open lower end and concentric inner and outer shells, the inner shell having openings therethrough and the outer shell being substantially impervious;

an at least partially foraminous chimney for venting gas out of the blast shield; and a deflector within the inner shell, mounted over an inner end of the chimney, and including a point oriented downwardly toward the plume for radially dispersing the plume;

whereby gas of an explosive plume escapes more readily through the inner shell than liquid of the explosive plume.

* * * * *